United States Patent [19]

McInerny

[11] 4,216,952

[45] Aug. 12, 1980

[54] FEED MECHANISM FOR SEQUENTIALLY SEPARATING DOCUMENTS, SHEETS, COUPONS AND THE LIKE

[75] Inventor: George P. McInerny, Andalusia, Pa.

[73] Assignee: Technitrol, Inc., Philadelphia, Pa.

[21] Appl. No.: 869,663

[22] Filed: Jan. 16, 1978

[51] Int. Cl.[2] ..... B65H 3/52

[52] U.S. Cl. ..... 271/10; 271/34; 271/122

[58] Field of Search ..... 271/122, 34, 35, 125, 271/121, 123, 124, 172, 10, 281

[56] References Cited

U.S. PATENT DOCUMENTS

| | | | |
|---|---|---|---|
| 3,025,051 | 3/1962 | David et al. | 271/34 X |
| 3,027,161 | 3/1962 | Solyst | 271/34 UX |
| 3,044,769 | 7/1962 | Breuers | 271/172 |
| 3,052,465 | 9/1962 | David | 271/122 |
| 3,617,051 | 11/1971 | McInerny . | |
| 3,635,465 | 1/1972 | Beery | 271/122 |
| 3,709,482 | 1/1973 | Nelson et al. | 271/34 X |
| 3,857,559 | 12/1974 | McInerny | 271/122 |
| 3,944,210 | 3/1976 | McInerny | 271/35 X |
| 4,074,902 | 2/1978 | Bradbury | 271/34 |
| 4,085,929 | 4/1978 | Tuchiya et al. | 271/122 |

*Primary Examiner*—Bruce H. Stoner, Jr.

*Attorney, Agent, or Firm*—John C. Dorfman

[57] ABSTRACT

Documents in a stack are loaded into a bin from which an endmost document is fed by some means to a generally cylindrical drum having a high friction surface which is rotationally driven about its cylindrical axis. A plurality of resilient continuous stretchable friction belts of lower friction than the high friction drum surface are arranged parallel to one another around pulley supports positioned such that non-friction circumferential areas around cylindrical drum surface stretch the path of the continuous belts between adjacent pulleys. The continuous belts are driven in the opposite direction from the high friction cylindrical surface of the drum. The opposed moving surfaces separate adjacent sheets while the belts apply a normal pressure to a document on the high friction surface so that it draws the endmost document from the stack and carries the separated single document through the mechanism by itself.

28 Claims, 13 Drawing Figures

FEED MECHANISM FOR SEQUENTIALLY SEPARATING DOCUMENTS, SHEETS, COUPONS AND THE LIKE

BACKGROUND OF THE INVENTION

The present invention relates to a feed mechanism for use in connection with document handling machinery but specifically adapted for the purpose of separating documents, sheets, coupons and the like. More specifically, the present invention relates to such a mechanism which is capable of separating documents from one another so that they may be fed individually one at a time to a subsequent mechanism and which is self-adjusting to accept documents of different thicknesses.

In the prior art various types of feed mechanisms for separating documents and feeding those documents from a stack individually through further mechanisms have been devised. The prior art document selection mechanisms have been adjustable devices which have to be carefully adjusted for selected document thicknesses and which are subject to malfunction if thicknesses vary substantially from document to document. They have had to be relatively complicated structures in order to permit thickness selection. In some cases, their complication has made them or caused them to become difficult to adjust. Their adjustments and some of the rest of the mechanisms may be subject to getting out of adjustment or becoming permanently inoperable, particularly in circumstances where they may be roughly handled, as during shipment. Certain ranges of documents, particularly relatively thin documents such as tissues, are extremely hard to handle by any prior art device. Furthermore, it is difficult to assure that under some circumstances adjacent documents will not stick together and be passed through the rest of the mechanism and erroneously identified as a single document, leading to data errors as well as simple miscounts of documents.

SUMMARY OF THE INVENTION

The present invention is directed to a device which relative to the prior art is extremely simple, both in its structure and concept, yet it is radically different from the prior art. The device of the present invention is self-adjusting to handle documents over a great range of thicknesses and eliminates the need for any kind of thickness adjustment mechanism, thus disposing of any need for expensive precision parts and mechanisms which are easily thrown out of adjustment. In fact, the present invention requires essentially no adjustment and is self-correcting to handle different sheet thicknesses. This self-correcting ability is sufficiently great that it can handle a stack of documents intermixed with different sizes, and particularly of different thicknesses, so that, for example, cards or cardboard and paper of different thicknesses and consistency, including thin tissue paper, can be handled in any sequence by the same mechanism without adjustment. Moreover, no initial adjustment is required at the time of installation. In use, it is much more flexible, versatile and adaptable in its various applications and not subject to waste or damage of documents through improper adjustment.

Since the mechanism of the present invention is extremely simple, it is easily assembled. Manufacturing is much less of a precision job because the parts need not be precision and the considerable tolerance to document handling accrues to the benefit of the mechanism itself.

The present invention is not only capable of accepting documents of different thicknesses, but it is capable of accepting and handling documents which cannot be handled by prior art equipment such as extremely flimsy documents and documents with curled, bent or ruffled edges or which have been somehow or other folded, creased, spindled or otherwise damaged in prior handling.

Another outstanding feature of the present invention is its ability to separate documents which have a tendency to stick together. In fact, this ability is so great that one embodiment of the mechanism is capable of separating pieces of sandpaper with their abrasive sides face to face.

More specifically, the present invention relates to a mechanism for sequentially separating single sheets from a stack. A support frame for the mechanism provides support for the drive means and supports bearings for various rotating elements. At least one resilient continuous stretchable friction belt having a friction surface is supported by spaced apart rotatable supports defning a belt path on the supporting frame. A generally cylindrical drum structure is supported on the support frame has a friction surface extending around the drum across portions of its width. The drum structure also provides non-friction surfaces over which the at least one continuous belt is stretched from a straight path between support means into a taut conforming path over part of the non-friction surface of the cylindrical drum structure. Drive means is provided on the support frame for driving the continuous belt in one direction and the friction surface of the drum structure in the opposite direction. Finally, means is provided to feed sheets into the nip between the at least one continuous belt and the drum, thereby causing selection of only one document at a time.

The present invention lends itself to numbers of detailed variations, some of which will be described hereafter, and, in addition, to a variety of positional orientations which may facilitate handling of documents or association with transporting means following the separating mechanism, such as document processing and/or output stacking apparatus.

For a better understanding of the present invention reference is made to the accompanying drawings in which.

Figure 1:
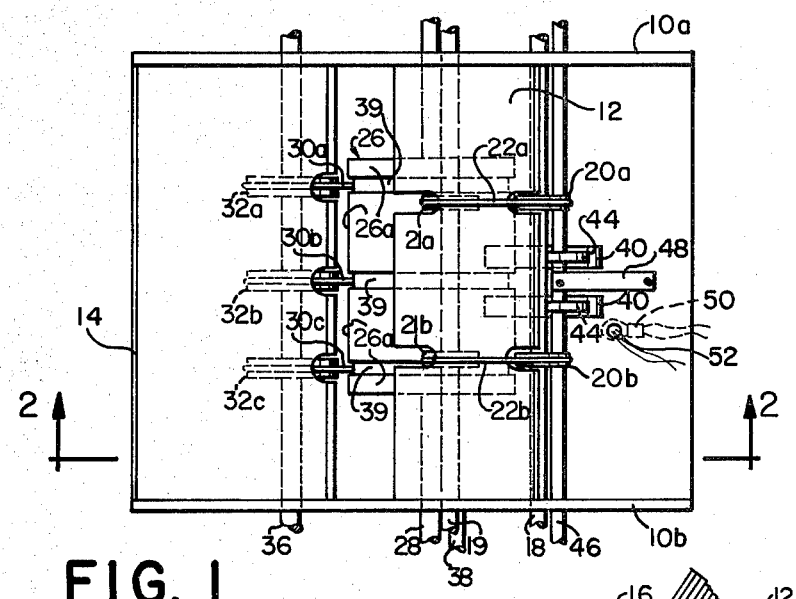
FIG. 1 is a plan view from above of a preferred embodiment of the invention, omitting drive structure, and having an overhead document feed.
Figure 2:
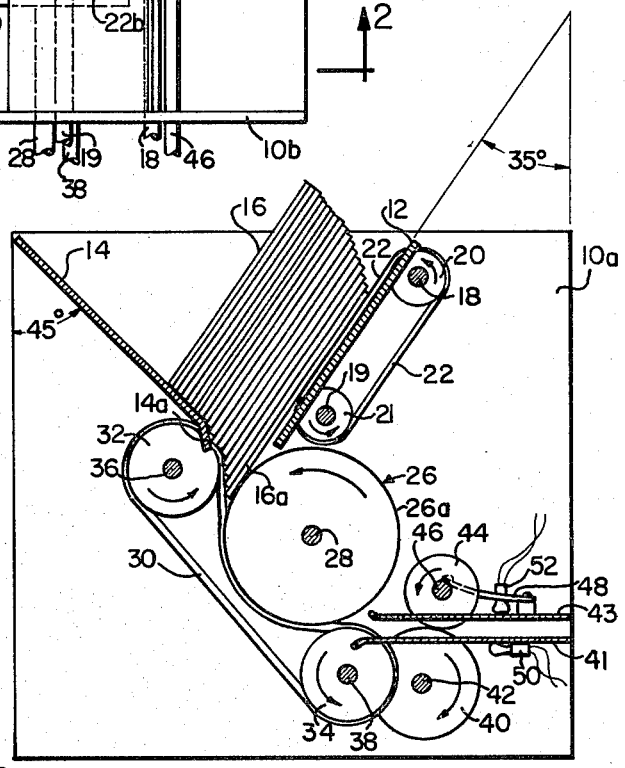
FIG. 2 is a sectional view taken along line 2—2 of FIG. 1.

Referring first to FIGS. 1 and 2, a device for separating single sheets of documents from a stack of documents is illustrated showing essential structure but omitting some conventional structural details and omitting the drive structure. The drive structure is also conventional but is shown schematically in FIG. 7. It will be understood by those skilled in the art that the mechanism shown is the input end of a more elaborate document handling machine having additional functions and that this device is ordinarily used in connection with other mechanisms. An example of such a complete system employing a number of mechanisms having distinct functions is shown in my previous U.S. Pat. No. 3,617,051. In any such device a supporting frame is required, which may be a frame in common with other parts of the system or may be separate frames either mechanically connected together or mounted on a common support. In this case, the support frame is provided by a pair of sidewalls 10*a* and 10*b*, preferably rigid in themselves, or suitably reinforced to provide necessary support rigidity, and provided with such cross connections and bracing as needed in a manner well-known in the art to provide overall rigidity for the mechanism and support for its drive and rotational elements.

As shown in FIGS. 1 and 2, a generally downwardly converging V-shaped hopper for document is provided by a conveyor plate 12 and a support plate 14. In this instance, the conveyor plate 12 is disposed at an angle of about 35° from the vertical plane and the support plate 14 is about 45° from the vertical plane. Support is provided at opposite edges for each of plates 12 and 14 by the sidewalls 10*a* and 10*b*. The document stack 16 is placed with the bottom edges of its supported documents against support plate 14. The endmost document 16*a* is against the conveyor plate 12. The conveyor plate 12 and the support plate 14 converge but do not actually intersect. The space left between them must be of at least a sufficient size to permit the feed of at least several documents of maximum thickness to be handled, and is preferably larger. Preferably, the bottom edge of the support plate 14 is turned away from the document stack to assure that there will be no interference by that edge as the documents are fed into the separating mechanism and the stack of documents, still on edge, slides down plate 14 toward conveyor plate 12.

Rotatably supported between the sidewalls in suitable bearings are pulley shafts 18 and 19, each of which in this embodiment supports two similar pulleys 20 and 21, respectively. One pulley on each shaft supports continuous conveyor belts 22. Two such belts 22*a* and 22*b* (FIG. 1) are employed in parallel belt paths around their respective pulleys 20*a* and 21*a* and 20*b* and 21*b*. Parallel paths are provided by virtue of corresponding spacing of the pulleys on each of the shafts 18 and 19, the pulleys being at corresponding distances from each other and from the sidewalls in each case. The placement is such that the belts while spaced apart are located toward the center of the conveyor plate 12. The pulleys 20 and 21 are also arranged so that the continuous belts paths are normal to and located primarily below the conveyor plate 12. However, the belts have straight parallel runs over the conveyor plate paths generally parallel to and as close as possible to the plane of the plate 12.

Figure 7:
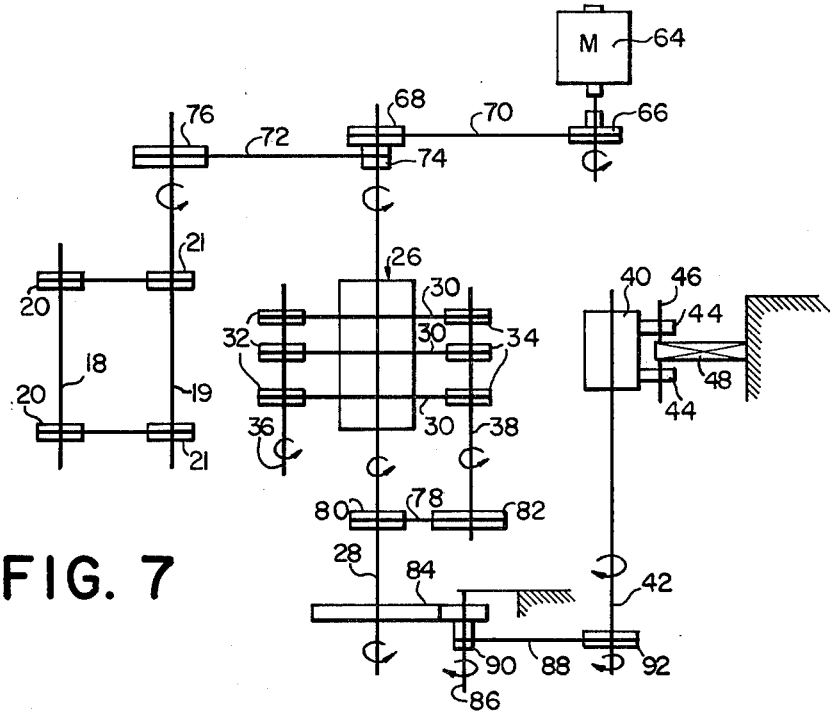
FIG. 7 is a diagramatic showing of a suitable drive mechanism useful in the various embodiments of the present invention.

Preferably, a common drive means is provided for all of the rotating parts of the mechanism as will be explained in connection with FIG. 7. The drive means imparts rotation to shaft 19 in the direction shown by the arrow on pulleys 21 and thereby drives the portion of the conveyor belts above belt 22 above the conveyor plate 12 in a downward direction. The conveyor belts 22 are made of a material providing friction and tend to move documents pressed into them normally in a lateral downward direction. The pressure of the documents stack 16 on the endmost document 16*a* in contact with plate 12 and bands 22 causes the bands which protrude above the plate 12 to drive the document downwardly through the opening between plate 12 and 14. The conveyor belts 22 are preferably either flat and quite thin or round, or of other cross sections having thickness, and lie within recesses so that they protrude above the supporting surface of the conveyor plate 12. The documents are gravity fed in this embodiment so that in the stack 16, they slide on their edges down the 45° support plate 14 toward the conveyor plate 12. It will be observed that these preferred angles provide less than a right angle between them, and something on the order of 80°. This particular geometry has been found to work well and to avoid stack-ups and jamming at the V, but it is not regarded as a critical feature. Other angles, particularly in other types of feed arrangement, may be used in accordance with the present invention. When used, however, the combination of angles described has the advantage that it provides sustained feeding from the document stack 16 while at the same time distributing the weight of the stack so that most of it is on the bottom edges of the individual documents, which facilitates easier separation of the documents from one another. This general type of feed is sometimes known in the trade as an "edge feed" and this particular feed arrangement is modified over those known in the prior art and provides the advantage of permitting handling of large packs of documents (e.g., over 300 documents) and provides even and regular feed without external pressure even if documents thicknesses are intermixed. However, it will be understood by those skilled in the art that, even using this geometry, considerable variations in the angles stated as preferred, is possible and such variation is intended to be within the scope of the concept.

Figure 3:
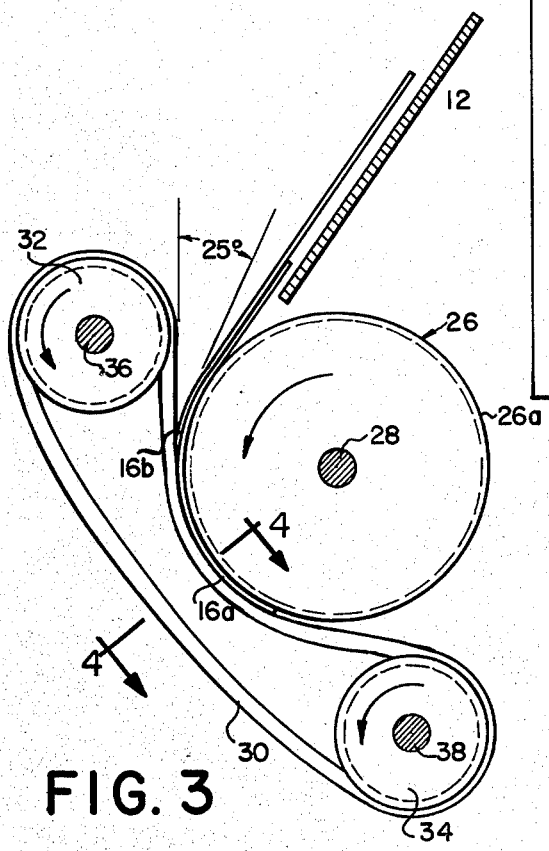
FIG. 3 is an enlarged detail view showing the drive and stripper structure of FIG. 2.
Figure 4:
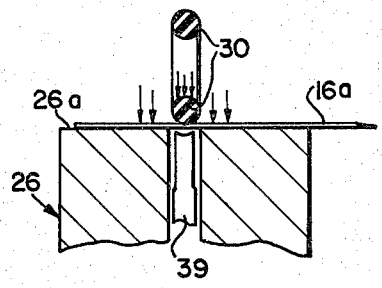
FIG. 4 is a detailed sectional view taken along the 4—4 of FIG. 3.

Below the opening between the plates 12 and 14 and preferably located so that its surface is generally tangential to the top surface of the conveyor plate 12 is generally cylindrical drum 26 supported on common drive shaft 28, which like shafts 18 and 19 is supported in bearings on the sidewalls 10*a* and 10*b* to permit rotation. Shaft 28 is driven by the common drive means. In a preferred embodiment, high regions 26*a* along the length of the drum are fixed to and driven by shaft 28. The drum 26 may be several cylindrical pieces located side by side on shaft 28 spaced over the entire distance between the sidewalls 10*a* and 10*b* or concentrated toward the center. Alternatively, drum 26 may be a single unitary generally cylindrical drum. In either event, in preferred embodiments, at least a substantial area of the cylindrical surface 26*a* is provided with a high friction material extending circumferentially around the drum. Such material will tend to draw documents with considerable force once applied with nominal normal force or pressure to the frictional surface. Documents fed tangentially to the rotating cylindrical drum are fed into a nip between the drum face 26*a* and an array of parallel stripper belts 30. The stripper belts 30 are supported on pulleys 32 and 34 which with the drum 26 define their belt paths. A plurality of similar pulleys 32 and 34 are, in turn, supported side by side spaced apart from one another and between walls 10*a* and 10*b* in similar positions on shafts 36 and 38, respectively. Each stripper belt 30 is formed of resilient continuous stretchable friction material and its supporting pulleys are positioned in such a way that the belt path is stretched from a straight path between two pulleys by a portion of the circumference of rotary drum 26, as best seen in FIG. 3. Drive pulleys 32 through shaft 36 are driven by common drive so that their movement over the drums is shown schematically in FIG. 7 in opposition to the direction of rotation of the drum 26. Stripper belts 30 in preferred embodiments are made of lower friction material than the high friction surface members 26*a* of drum 26. However, movement of the lower friction material in the reverse direction to high friction drum 26*a* movement makes it essential as a practical matter that the belts 30 not be directly opposed by the high friction material of the drum surface. In particular, preferably the high friction material on the drum surface 26*a* is not continuous over the whole length of the drum. Instead, a non-friction area is provided in a circumferential band opposite each of the counter-rotating stripper belts 30. This may be a low friction area without the friction coating or with a non-friction coating added. In fact, in preferred embodiments, it is desirable to provide a free wheeling pulley element 39, free to rotate about shaft 28 and independent of the high friction surface drums 26*a* which are attached to and driven by the shaft. However, a non-friction surface will be understood to mean herein either a low friction band on the drum or a free wheeling pulley. The pulleys 39 are preferably similar to, but larger than, idler pulleys 34 and serve in the same sense as part of the path defining means for each of the stripper belts. In this connection, as perhaps seen in FIG. 4, to facilitate use of conventional pulleys, it may be preferred to use O-rings or belts of circular cross-section for the counter-rotating stripper belts 30. Also as shown in FIG. 4, as the document is fed into the nip between the stripper belts 30 and the drum 26, the resiliency of the belts 30 will allow them to be further deformed away from the drum pulleys 39 than their preliminary stretching causing them to conform to the cylindrical surface. This further stretching, as shown in FIG. 3, will cause an inward restoring force, represented by the small arrows, acting against the document 16*a* generally normal thereto and tending to hold it in place on the drum 26. Thus, the stripper belts, despite their counter rotation, provide the normal force necessary to make the higher friction drum surface 26*a* effective to pull the document through the space between the belts and the drum against the counter movement of the stripper belts. It will also be apparent that by the use of rubber or some other inherently resilient material, the stripper belts 30 are self-adjusting and will accommodate to whatever the thickness of a document being fed through without need of further adjustment. A second document 16*b* behind the first and thereby shielded from the high friction surface will be moved in the opposite direction by the friction of the stripper belts 30.

It will be observed that in other embodiments, instead of providing free wheeling pulley 39, a band of low friction materials, e.g., Nylatron® may be applied between areas of the high friction surfaces 26*a* to minimize the wear on the counter-rotating belts 30 when no document intervenes. Like the pulley surface, the low friction bands may be curved to help guide the band in its proper course and away from the adjacent high friction surfaces.

If the device is arranged to be run only when documents are being fed, it is even possible to omit any special treatment of the drum 26 opposite the stripper belts, but such a construction is not preferred for obvious reasons. Where a continuous stream of documents is fed between the counter-rotating belts 30 and the drum surfaces 26*a*, the need for low friction surface opposite the counter-rotating belts is reduced or eliminated, since the bands will be subjected to little wear effect. It is possible to build a system which is turned on and off on demand as documents are fed without the provision such as those of the preferred embodiment of avoiding direct friction surface opposition between high friction drum areas and the stripper belts. The preferred embodiment is not subject to damage due to carelessness and avoids the need for a knowledgable or even a skilled operator or monitoring equipment.

It will also be observed in FIG. 1 that three parallel counter-rotating stripper belts 30 are employed. The number and distribution of these belts is a matter of design, but the three belts distributed as shown has proved to be highly effective. In another design fewer or more counter-rotating belts and/or different geometries may be employed. Of course, the belts need not be O-rings but can be other cross-sections instead.

Following the document separation means a document acceleration device is provided in order to sequentially space the documents apart from one another once they have been separated. Such separation facilitates counting and also enables unambiguous location of the leading edge of each document. The acceleration device includes a high friction accelerator roll 40 fixed to rotate with shaft 42 supported in bearings on the sidewalls 10*a* and 10*b* and driven by the drive means as shown in FIG. 7 at higher speed than friction roll 26. Friction roll 40 cooperates with a follower roll 44 on shaft 46 also rotatably supported by the sidewalls 10*a* and 10*b*. The follower roll 44 is spring loaded by leaf springs 48 suitably supported on a cross member of the frame. The springs 48, urge the follower roll 44 into contact with the stripper roll 40, in such a way as to pinch documents guided by guide means 41 and 43 as they leave the space between the friction drum 26 and counter-rotating belts 30. Each document successively passes into the nip of rolls 40 and 44 where the high friction surface of roll 40 effectively pulls it away from the feeder stripper mechanism. Thus, for a time, the preceeding document is moved faster than the following document in order to allow a space between sequential documents to facilitate detecting or counting the individual documents. In this embodiment, a light source 50 and a photo pickup 52 supported on the frame and may be more immediately supported on guide members 41 and 43 on opposite sides of the document path.

Documents interrupt the light reception which recurs between documents to generate pulses when light is received at the photo pickup 52 from light source 50. Pulse downturns thus generated can be counted by conventional pulse counting devices of various types well known in the art to provide a document count. A speed ratio between rolls 26 and 40 of 3 to 1 was successfully used in one mechanism to provide sufficient spacing between documents to permit counting.

The high friction drum surface 26*a* may provide too much resistance to removal of the documents, particularly in combination with the arcuate wrap around of the documents. In situations where it proves that documents are extremely difficult or impossible to remove using the technique shown, at least two alternative arrangements, shown respectively in FIGS. 5 and 6, are possible.

Figure 5:
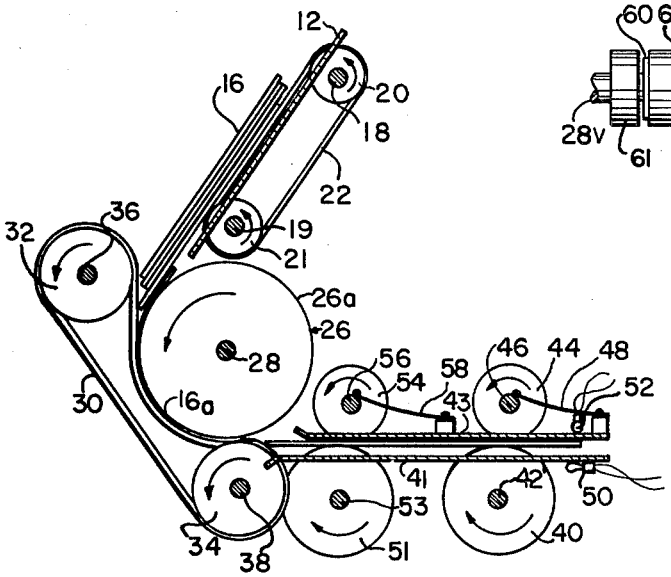
FIG. 5 is a partial view showing some of the structure of FIG. 2 with additional document acceleration structure.

FIG. 5 shows a modification to the structure of FIG. 2 in which the high friction roll 40 and follower roll 44 are simply moved further away from the output from the high friction drum 26*a*. Intermediate their new position and the high friction roll 26 are interposed a pair of similar rolls 51 and 54, similar to roller 40' and 44' but of somewhat lower friction and of the same surface speed as drum 26. Rolls 51 and 54 are capable of allowing documents to slip or be pulled from them by roll 40'. Spacing is such that this will occur only after the document has left drum 26*a*. Roll 51 is supported on shaft 53, and the follower roll 54 on shaft 56. The shafts are supported by the frame sidewalls and on a suitable crosspiece springs 58, similar to springs 48, are employed to apply pressure. It is even possible to provide that rolls 51 and 54 are running at a higher speed because their ability to slip on the surface of the document permits the document to proceed at a slower feed speed until it is released by high friction drums 26*a*, after which it can pick up speed to the driven surface speed of roll 51. In other respects, the systems of FIGS. 1 and 2 and FIG. 5 are the same so that further explanation is unnecessary, and it was unnecessary to illustrate the whole system in FIG. 5.

Figure 6:
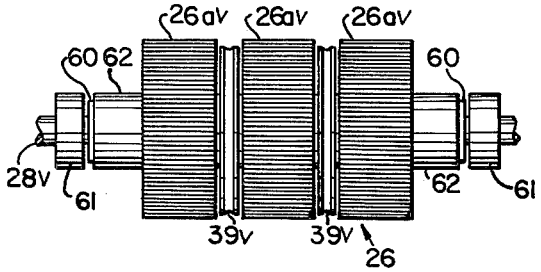
FIG. 6 is an elevational view of a cylindrical drum modified to include a further document acceleration feature.

The second alternative for separating documents is substitute of drum construction shown in FIG. 6 wherein the structure of FIGS. 1 and 2 remains unchanged in other respects. Instead of directly securing the high friction drums 26*a* to the shaft 28, with intermediate pulleys 39 free wheeling on shaft 28, an intermediate structure is interposed, including conventional one-way or override clutches with the shaft rotatably supported on the sidewalls 10*a* and 10*b*, in the same manner. Override clutches 60 which are pressed into both ends of a tubular outer shaft 62 to which the drum members 26*a*V are fixed instead of being fixed directly to shaft 28V. The tube assembly is positioned on the support shaft 28V and held in place by collars 61. Pulleys 39V can ride on the outer surface of shaft 62 also. The nature of the clutches 60 is such that when the drum is pulling documents from the stack, the drums 26*a*V are driven and must rotate at the driven speed. However, when documents are being pulled away from friction drum 26*a*V at a higher speed, the clutches 60 permit the drums 26*a*V to run faster than the shaft 28V.

The previously described drawings have not included drive structure in order to avoid confusion due to complexity, but each shaft, drum, roller or pulley which is driven has been so indicated. Corresponding parts may be identified on the schematic diagram of FIG. 7 by the number designators previously used. FIG. 7 is intended to show one way drive occurs in accordance with a preferred embodiment of the present invention. It will be understood that the rotating shafts, and other structures which require support of some kind, including springs and the like, are either supported from the sidewalls 10*a* and 10*b* or from some other cross member or part of the support frame. The motor 64 may be supported either inside or outside on a sidewall, for example, on a suitable bracket. Depending on whether belts or chains are used, motor 64 is provided with a drive pulley or sprocket 66 on its shaft to drive a similar pulley or sprocket on shaft 28 through belt or chain 70. As shown, belt or chain 72 connects pulley or sprocket 74 on shaft 28 and pulley or sprocket 76 on shaft 19. Shaft 28 through pulley or sprocket 80 also provides drive for shaft 38 through belt or chain 78 to pulley or sprocket 82 on shaft 38. A gear box 84 supported on the frame receives an input through shaft 28 and provides an output through shaft 86. Belt or chain 88 between pulley or sprocket 90 on shaft 86 and pulley or sprocket 92 on shaft 42 provides the higher surface speed required for friction roll 40.

By way of recapitulation, referring again to FIGS. 1–4 and 7, in the use of the mechanism, a stack of documents 16 is placed into the bin formed by plates 12 and 14 so that the endmost documents rests against the conveyor belts 22. These conveyor belts drive the document downward into the V and tangentially into the high friction drum surfaces 26*a* of drum configuration 26. When the lower friction stripper belts 30 contact the document, they supply the normal force to hold it into frictional engagement with the high friction surface 26*a* over the arcuate portion of the drum where the belts 30 are in contact. The counter-rotating nature of the stripper belts will not be effective to prevent the movement of the endmost document 16*a* of the stack 16 through the mechanism, but another document 16*b* behind the endmost document is easily held back by the movement of belts 30 until the endmost document 16*a* is fed through past the nip and document 16*b* can contact the high friction drum surfaces 26*a*. This has been the result even in the situation where sandpaper is placed face to face in at least one preferred embodiment of the invention tested. In some cases, a particular type of high friction surface 26*a* might be composed of a special kind of rubber, such as urethane rubber, with a known additive to increase its friction. If certain materials, such as synthetic rubber of various types, were used for the belts 30, sufficient friction is inherently supplied. In other cases, particularly on surface 26*a*, additional friction may be added by providing a tread as shown in FIG. 6 or a roughened surface to the surface which contacts the documents. When a document 16*a* passes through the area of contact of the drum 26*a* and belts 30, it is directed by the guide plates 41 and 43 into the nip of acceleration roll 40 driven at high speed and following roll 44. This, in turn, will tend to draw the documents 16*a* more rapidly away from the high friction roll 26*a* and thereby to cause separation between it and the next document 16*a* so that the spacing between the documents will be a measurable amount which will permit passage of light from source 50 between the documents to photocell 52. As previously explained, various other means, such as those shown in FIGS. 5 and 6, can be used to accelerate and exaggerate the spacing between the documents.

It is to be noted that some successive sheets are particularly difficult to separate because they themselves provide a high surface friction. Papers, unlike sandpaper, are ordinarily of equally high friction on both faces. Thus, the counter-rotating stripper belts will encounter more effective friction with some documents causing the stripper belt to pull tight against the drum and stretch between the drum and the belt drive. It will be understood that, in a situation where drive occurs at a pulley, after the contact with the document in such a way as to effectively pull the band or belt away from the contact area, a greater frictional effect will cause the elastic band or belt to pull more tightly against the surface and thereby exert more force to effect stripping other documents away from the endmost document. It can be said that the greater the surface friction of the documents, the greater the stripping force on the documents, and the greater the feed roll drive force required.

In preferred embodiments, the radius of the guide pulley 39 is about 0.035 inches less than the radius of the high friction drum 26*a* which may have a diameter on the order of 1 to 5 inches. It is desirable to keep the bridging effect shown in FIG. 4 to a minimum to make the gap between high friction drum members 26*a* as small as possible in order to prevent the distortion of thin documents into the shape of the guide pulley. It is also desirable that belts 30 not be too taut for the same reasons. A tread design, such as slots or grooves, on the friction surface 26*a* of the rotating drum will insure a steadier sustained feed rate on particularly slippery documents, but the friction surface in most instances is sufficient without a tread. It should be noted in passing, for example, that synthetic rubber with high wear characteristics but lower friction than natural rubber may require tread.

Figure 8:
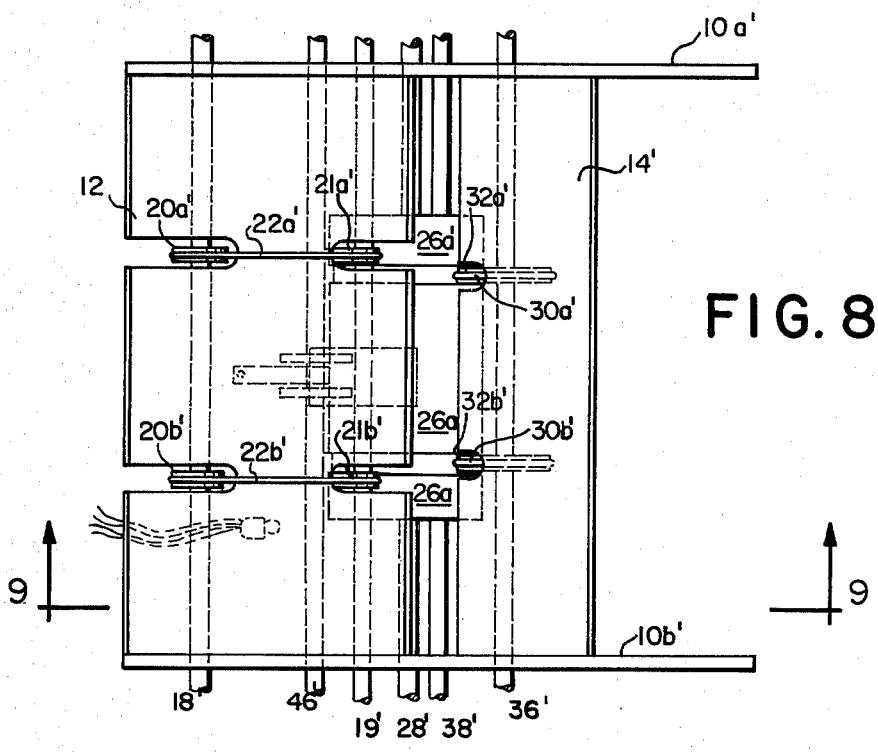
FIG. 8 is a plan view from above of a modified version of document separation mechanism in accordance with the present invention.
Figure 9:
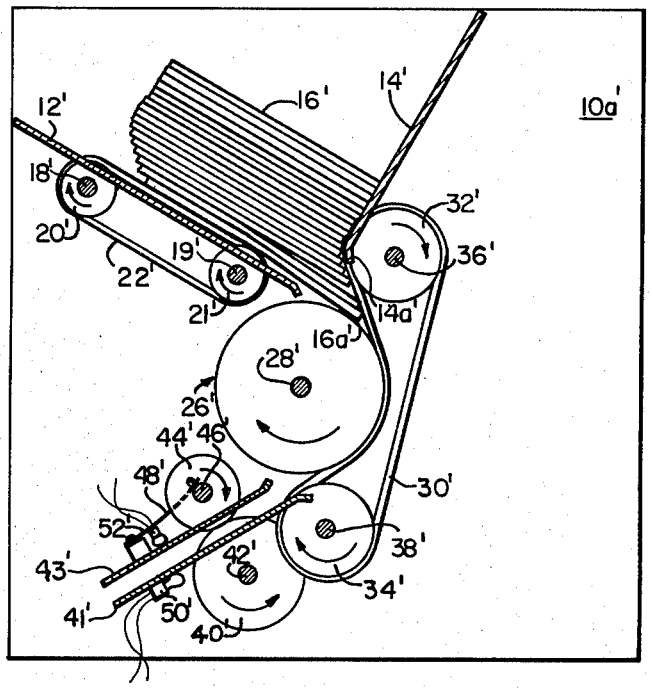
FIG. 9 is a sectional view taken along line 9—9 of FIG. 8.

Referring now to FIGS. 8 and 9 another embodiment of the invention is shown which differs primarily in a reorientation of essentially the same parts. The parts which are analogous in all respects to those shown in FIGS. 1 and 2 are given similar number designators to those assigned to corresponding parts in FIGS. 1 and 2 but with the addition of primes thereto. As seen in FIG. 9, the conveyor plate 12' is disposed at about 30° to the horizontal and the support plate 14' is arranged generally perpendicular to it. It will be observed that the mechanism of FIGS. 8 and 9 is effectively a mirror image of that of the mechanism of FIGS. 1 and 2. Additionally, the overall system has been rotated about the axis of drum 26 or about shaft 28. Thus, the input feed to the high friction surface 26*a'* and the nip formed with counter-rotating belts 30' results in a feed angle which is much closer to the horizontal. The output of the system, on the other hand, is no longer horizontal as it is in FIGS. 1 and 2 arrangement and now the guides 41' and 43' are directed downwardly, instead of horizontally along the path of the acceleration roller 40'. The drive system employed is essentially the same as that shown diagramatically in FIG. 7, and the operation is quite similar. All modifications described can be made to it as well. This embodiment of the invention serves to illustrate that specific orientation is not essential to the operation of the feed mechanism of the present invention and that various orientations can be supplied to meet specific needs of feed and cooperation with other following mechanisms.

Figure 10:
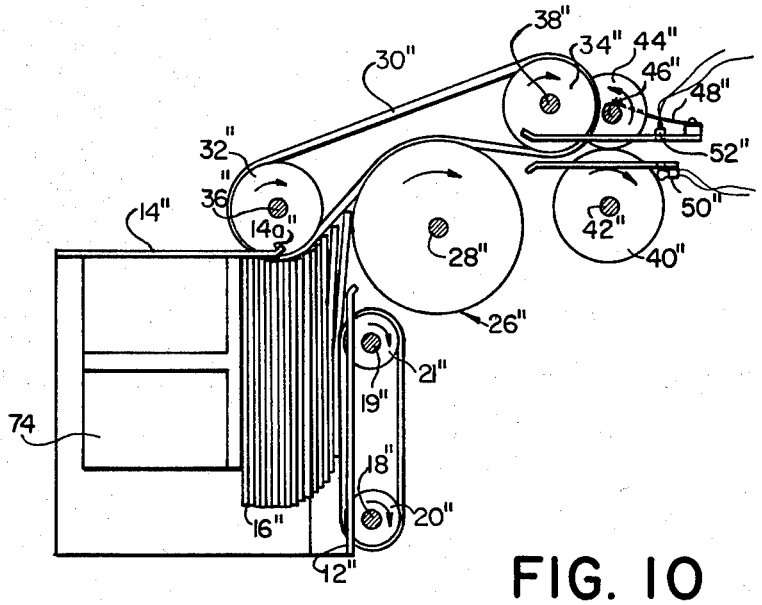
FIG. 10 is a plan view from above of another embodiment of the document separation mechanism of the present invention having a side or end feed.
Figure 11:
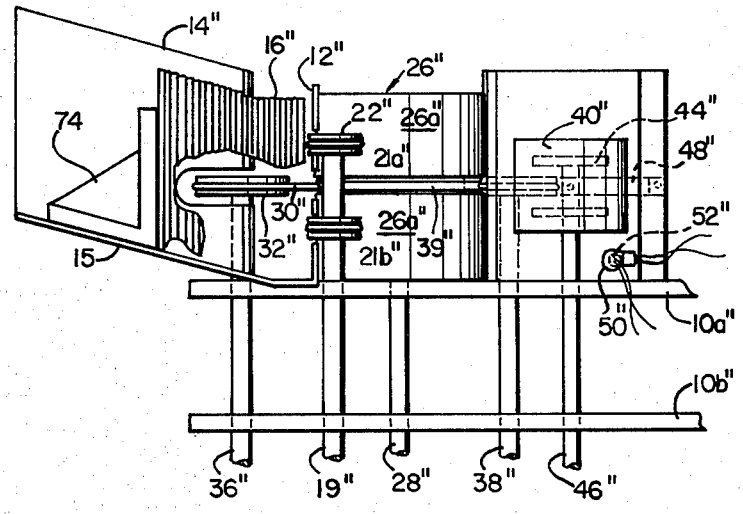
FIG. 11 is a side elevational view of the structure of FIG. 10.

FIGS. 10 and 11 represent still another embodiment of the present invention which has some different aspects but again is sufficiently similar to the mechanism of FIGS. 1 and 2 that corresponding parts can be given the same number designators with the addition of double primes. However, as will be observed in FIG. 10 which is a plan view from above, the arrangement involves a lateral feed along a supporting ramp 15 with a suitable follow-up device 74, preferably of a spring loaded type and of conventional form, for the purpose of keeping the stack of documents under some pressure while urging them toward the support plate 12'' which is vertical so that gravity is of no effect and the documents are driven into the nip between drums 26'' and stripper belts 30'' entirely by conveyor belts 22.

It will also be observed that the whole mechanism is oriented at 90° to the mechanisms of FIGS. 1 and 2 and of FIGS. 8 and 9. That is, instead of the axes of rotation being horizontally oriented, they are vertically oriented. The support structure will, of course, have to be appropriate for the circumstances and, at least in some instances it will be desirable to cantilever the rotational shafts and support them from below, for example, in bearings in parallel decks 10*a''* and 10*b''*. The drive structure still remains similar to that of FIG. 7 and may be located between the decks or beneath deck 10*b''*. It will also be observed that as the documents come out of the feed mechanism they are on edge which may pose no special problems in the mechanism, but special precautions may be needed to handle the documents thereafter. However, within the feed and separating mechanism itself, the reorientation of structure effectively makes no difference to its operation.

An important feature of the present invention is its ability to handle documents with curled edges, or otherwise less than perfect sheets. It is desirable to keep the angle between the high friction surface 26*a* and the counter-rotating stripper belt 30 small enough to prevent curling back of the edges of ruffled documents. Conventional friction feeds require an angle of perhaps 40° to 45° to prevent a wedging effect. The present invention can take a much smaller angle of something between 25° and 35°, depending on the geometry of the individual system, without wedging and a narrower pinch angle helps to assure proper handling of all documents. Wedging, if it occurs, jams the system and can result in destruction of the documents. In most systems it may create a situation in which maintenance service is required. The mechanism of the present invention is less susceptible to wedging than prior art devices and when properly designed, wedging should never occur in a mechanism of the present invention.

From the above it will be understood by those skilled in the art that a relatively simplified, but highly effective means, for separating the documents is provided by the present invention. It can be seen that the means is capable of operating in different orientation. However, in whatever orientation it operates, the operation is essentially the same.

The numbers of a particular part employed may be significant in a given design but other designs are contemplated within the scope of the invention. For example, the embodiment of FIGS. 10 and 11 show only one stripper belt 30'', whereas the embodiment of FIGS. 8 and 9 show two 30*a'* and 30*b'*, and the embodiment of FIGS. 1 and 2 show three 30*a*, 30*b* and 30*c*. The width of a given belt cross-sectional shape and the kind of pulley employed can vary within wide ranges. Variations in the drum 26 necessarily follow stripper belt modifications alluded to but as suggested above, there can be additional variations in the use of pulleys, Nylatron® coated tracks or no modifications at all in the drum surface. These changes in the critical area are most noticable but similar kinds of changes are equally possible in other parts of the structure and are all contemplated within the scope of the claims. Other variations within the scope of the invention include reversing the functions of the high friction drum and the stripper belts. This would involve at least reversing the direction of these parts and interchanging their frictional materials. Larger width belts, which become friction drive belts, cooperate with "stripper drums", the friction effect of which would probably be reduced by reduction of the drum area covered with friction material. The stripper drum 26 might also be of much smaller diameter.

It is also possible within the scope of the invention to provide the high friction surface of drum 26 simply be a continuous belt having a high friction surface running around another spaced roller in addition to the drum. Thus, looking at the matter in another way, there would be additional pulleys for a wide belt or belts, and the drum 26 constituting one of the pulleys with the belt running around it.

Figure 12:
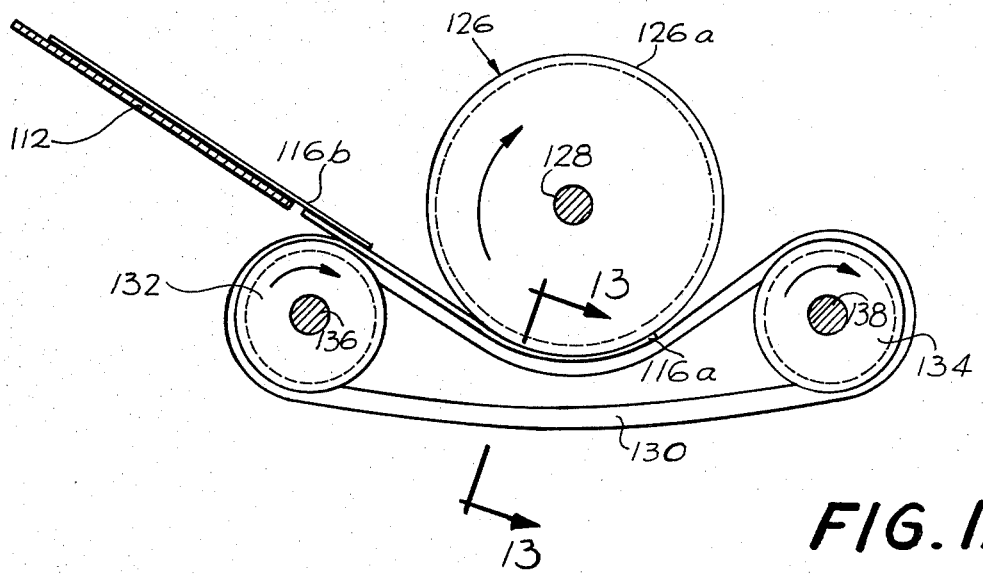
FIG. 12 is a view similar to FIG. 3 showing a reversed drive and stripper structure.
Figure 13:
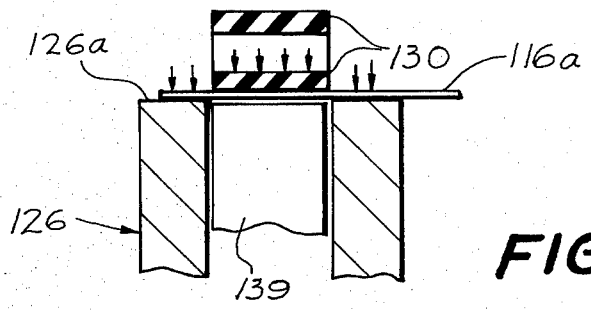
FIG. 13 is a sectional view taken along line 13—13 of FIG. 12.

FIGS. 12 and 13 illustrate such a possible situation. In this case, the belt 130 is the high friction surface providing the drive means and the roller 126 provides a lower friction surface and possibly narrow bands of the lower friction material 126*a*. The roller or drum 126 is driven by shaft 128 in opposition to the movement of belt 130 and this counter-rotation provides a stripping action.

As is seen, the belt is driven through one or both of the pulleys 132, 134 over which it passes through one or both of the shafts 136, 138. As best seen in FIG. 13, the belt 130 in this instance is preferably wider, or multiple belts are employed. This necessitates the use of a wider pulley 139 having a free-wheeling mounting on shaft 128 to provide the deflecting and stretching of the belt 130 which remains composed of resilient material which seeks to restore its original shape in the absence of opposing forces.

In this case, paper is fed from a feed including a feed tray 112. In accordance with the arrangement, the bottom sheet will be drawn by the higher friction belt 130 between the belt and the rollers 126, and the upper sheet 116*b* will be opposed by the counter-rotation of the drum and its high friction surfaces 126*a* to effectively strip away more than one sheet passing under rollers 126.

Although the parts have been reversed in function and direction of rotation, the principal in operation is the same. The device of FIGS. 12 and 13 can be made as effective as devices of the type of FIGS. 3 and 4. Either variation may be preferred under certain circumstances.

Several variations have been suggested and other variations will occur to the person skilled in the art. Such modifications and variations within the scope of the claims are intended to be within the scope and spirit of the present invention.

I claim:

1. A document separation system for separating sheets from a stack one at a time in a sequence determined by the order of the documents in the stack comprising:

a support frame, a resilient continuous stretchable friction belt, providing a first friction member and constituting a self-adjusting member permitting accommodation of documents of different thickness and different surface friction characteristics, separate rotatable support and path defining means on the frame for supporting said continuous stretchable friction belt, two coaxial generally cylindrical friction drums of like diameter rotatably supported on the support frame, each having a friction surface extending around the drum and together providing a second friction member, a non-friction drum of approximately the diameter of the friction drum but of smaller diameter and coaxial with and between the two friction drums over the surface of which the continuous stretchable friction belt is stretched from a straight path between support means into a taut conforming path over the non-friction drum surface to thereby supply forces acting normal to a sheet passing between the stretchable belt and the drums to generate frictional forces parallel to the sheet, and drive means on the support frame for driving the continuous stretchable belt in one direction and the two friction drums together in the opposite direction, such that the first and second friction members are moving in opposite directions over a sheet passing between them and when more than one sheet enter the space between the friction members only that sheet against the friction member moving forward will pass through the system and the friction member moving in the opposite direction will drive all other sheets successively rearward against forces tending to hold the sheets together.

2. The document separation system of claim 1 in which the resilient continuous stretchable friction belt is stretched from a path between only two rotatable support and path defining means by the intervention of the non-friction drum surface which deforms the friction belt and places said belt under tension.

3. The document separation system of claim 2 in which intervention of a sheet between the drum and the resilient continuous stretchable friction belt further increases the belt tension and the friction forces.

4. The document separation system of claim 2 in which there is at least one more resilient continuous stretchable friction belt, associated rotatable support and path defining means for each friction belt, and separate associated coaxial non-friction drums of the same size for each friction belt in generally parallel spaced apart planes.

5. The document separation system of claim 4 in which each resilient continuous stretchable friction belt is located axially between friction drums.

6. The document separation system of claim 2 in which the friction belt is an O-ring.

7. The document separation system of claim 1 in which the friction surface of each of the generally cylindrical friction drums is a high friction surface driven in such direction as to pull sheets away from a stack of sheets in a feed means and the at least one resilient continuous stretchable friction belt is a lower friction device moving over the region of its contact with the drum in the direction opposed to the surface movement of the drum to provide a stripping or separating function on sheets passing together between the drums and the belt.

8. The document separation system of claim 7 in which the non-friction drum is separately rotatable about the same axis as the friction drums but is not driven.

9. The document separation system of claim 8 in which the non-friction drum is a free wheeling pulley means capable of rotating with the friction belt.

10. The document separation system of claim 7 in which the non-friction drum and the friction drums are part of a single drum structure having a low friction circumferential region between high friction regions on the drum, said low friction region being opposed to and supporting said friction belt.

11. The document separation system of claim 10 in which the low friction region opposing the friction belt is coated with low friction material.

12. The document separation system of claim 7 in which each friction belt is composed of rubber-like material.

13. The document separation system of claim 12 in which the friction surface of the drum is provided with a tread surface.

14. The document separation system of claim 1 in which the resilient continuous friction belt provides the high friction member moving in such direction as to draw documents from a stack of sheets and the generally cylindrical drum rotates in opposition to the direction of movement of the continuous friction belt.

15. The sheet separating mechanism of claim 14 in which there are a plurality of belts of high friction material.

16. The document separation system of claim 1 in which the drive means for the friction belt is applied at that rotatable support and path defining means immediately following the friction drums in the direction of belt rotation, whereby resistance to separation of documents causes the friction belt to stretch and apply more force, thereby increasing the force tending to separate the documents.

17. A document separation system for separating sheets from a stack one at a time in a sequence determined by the order of the documents in the stack comprising:

a support frame, two similar and parallel resilient continuous stretchable friction belts, together providing a first friction member and constituting self-adjusting members permitting accommodation of documents of different thickness and different surface friction characteristics, separate rotatable support and path defining means on the frame for supporting each of said continuous stretchable friction belts, a generally cylindrical friction drum supported on the support frame, having a friction surface extending around the drum and providing a second friction member, non-friction drums of approximately the diameter of the friction drum but of smaller diameter and coaxial with and on each side of the friction drum over the surface of each of which one of the continuous stretchable friction belts is stretched from a straight path between support means into a taut conforming path over the non-friction drum surface to thereby supply forces acting normal to a sheet passing between the stretchable belt and the drums to generate frictional forces parallel to the sheet, and drive means on the support frame for driving the friction drum in one direction and the two friction belts in the opposite direction, such that the first and second friction members are moving in opposite directions over a sheet passing between them and when more than one sheet enter the space between the friction members only that sheet against the friction member moving forward will pass through the system and the friction member moving in the opposite direction will drive all other sheets successively rearward against forces tending to hold the sheets together.

18. The document separation system of claim 17 in which the rotating members have axes which have a major vertical component and feed means is provided to feed the sheets, bottommost first, laterally into the nip between the friction drum means and said friction belts.

19. The document separation system of claim 18 in which a feed bin means supported on the frame is provided to hold a stack of the sheets such that successive bottom sheets from the stack can be fed into the nip between said belts and the drum in the direction of that friction member which provides the greatest frictional effect, the orientation of that bin being such that the bottommost document is held against a bin wall having a vertical component parallel to the axes of rotation, suitable conveyor means is provided to move the bottommost sheet away from along said bin wall and auxiliary means is provided to maintain pressure on the stack of sheets.

20. The document separation system of claim 17 in which the rotating members providing the feed and separating mechanism are provided by cantilevered shafts supported by a generally planar support deck of the support frame which supports suitable bearings for the shafts, and the like.

21. The document separation system of claim 20 in which the support frame is comprised of at least a pair of parallel decks, the second deck arranged on the opposite side of the generally planar support deck from the friction drum means and said continuous friction belts.

22. The document separation system of claim 20 in which a common drive means is provided on one of the support decks on the opposite side from the friction drum means and friction belt structure.

23. The document separation system of claim 17 in which at the output end of the mechanism following the friction drum means and said friction belts there is provided acceleration roller means including a pair of engaged rollers at least one of which has a friction surface and at least one of which is driven at a higher surface speed than the surface speed of the high friction member of the sheet separating means, whereby sheets will be engaged by the accelerating rollers and move rapidly away from the separating means to ensure a spacing between the sequential documents.

24. The document separation system of claim 23 in which intermmediate the acceleration rollers and the separation mechanism is other conveyor means for moving the documents after they have left the separation means itself and to assure that the acceleration means does not engage the documents until they are entirely out of the separation mechanism.

25. The document separation system of claim 23 in which the driven element in the sheets separating mechanism is provided with an override clutch whereby a sheet when engaged by the acceleration rollers can be pulled at a greater speed than that of the separating mechanism from between the separating means.

26. The document separation system of claim 17 in which the resilient continuous stretchable friction belts are each stretched from a path between only two rotatable support and path defining means by the intervention of the non-friction drum surface which deforms the friction belt and places said belt under tension.

27. The document separation system of claim 26 in which intervention of a sheet between the drum and the resilient continuous stretchable friction belts further increases the belt tension and the friction forces.

28. The document separation system of claim 17 in which the drive means for the friction belts is applied at that rotatable support and path defining means immediately following the friction drum means in the direction of belt rotation, whereby resistance to separation of documents causes the friction belts to stretch and apply more force, thereby increasing the force tending to separate the documents.

* * * * *

UNITED STATES PATENT AND TRADEMARK OFFICE

CERTIFICATE OF CORRECTION

PATENT NO. : 4,216,952

DATED : August 12, 1980

INVENTOR(S) : George P. McInerny

It is certified that error appears in the above-identified patent and that said Letters Patent are hereby corrected as shown below:

Column 8, line 60, "16a" should be --16b--.

Signed and Sealed this

*Twenty-third* Day of *June 1981*

[SEAL]

*Attest:*

RENE D. TEGTMEYER

*Attesting Officer*

*Acting Commissioner of Patents and Trademarks*